United States Patent [19]

Weber et al.

[11] Patent Number: 5,027,716

[45] Date of Patent: Jul. 2, 1991

[54] STABILIZED SWING-MOTION TRUCK FOR RAILWAY CARS

[75] Inventors: Hans B. Weber, Rontonda West, Fla.; Jack R. Long, St. Charles, Ill.

[73] Assignee: National Castings, Inc., Lisle, Ill.

[21] Appl. No.: 447,262

[22] Filed: Dec. 7, 1989

[51] Int. Cl.[5] ..... B61F 5/06

[52] U.S. Cl. ..... 105/187; 105/208.1; 105/171

[58] Field of Search ..... 105/171, 174, 185, 187, 105/190.1, 190.2, 191, 192, 197.05, 197.2, 198, 202, 203, 208, 208.2, 208.1, 182.1, 206.1, 201

[56] References Cited

U.S. PATENT DOCUMENTS

| | | | |
|---|---|---|---|
| Re. 21,987 | 12/1941 | Green | 105/200 |
| 1,536,140 | 5/1925 | Priebe | 105/197.05 |
| 2,322,266 | 6/1943 | Willoughby | 105/190.2 |
| 2,347,628 | 4/1944 | Cottrell | 105/208 |
| 2,630,079 | 3/1953 | Cottrell | 105/197.2 |
| 2,717,558 | 9/1955 | Shafer | 105/197.05 |
| 2,879,718 | 3/1959 | Eksergian | 105/185 |
| 3,670,660 | 6/1972 | Weber et al. | 105/171 |

FOREIGN PATENT DOCUMENTS

| | | | |
|---|---|---|---|
| 0440419 | 2/1948 | Italy | 105/187 |
| 1204443 | 1/1986 | U.S.S.R. | 105/197.05 |
| 0807135 | 1/1959 | United Kingdom | 105/190.2 |
| 0970173 | 9/1964 | United Kingdom | 105/190.2 |

OTHER PUBLICATIONS

"LFM-Atchinson Cast Steel Express Trucks for High--Speed Service", Rockwell Manufacturing Company, Atchison, Kansas.

Lightweight Frame Brace product literature by Ca-n-Am Barber, Inc., Park Ridge, Illinois, 9/1988.

*Primary Examiner*—Robert J. Oberleitner

*Assistant Examiner*—Mark T. Le

*Attorney, Agent, or Firm*—Milton S. Gerstein; Marvin Benn

[57] ABSTRACT

An improved swing-motion truck in which the transom has been replaced by a pair of transverse radius or tie rods for coupling the two rocker seats of the two side frames of the truck. The ends of the rods are directly coupled to anchor brackets formed as part of the side-frame rocker seats via an elastomeric connection. The suspension springs of the railway freight car truck are seated directly upon the upper flat surface of the two rocker seats of the side frames of the truck, so that lighter-weight freight cars may be accommodated, without a friction-dependent coupling between the rocker seats and rods interconnecting the rocker seats, and where an overall lower height truck results to provide a low-deck car. The cooperating limit stops for lateral motion of the truck are mounted directly on the rocker seats themselves.

41 Claims, 6 Drawing Sheets

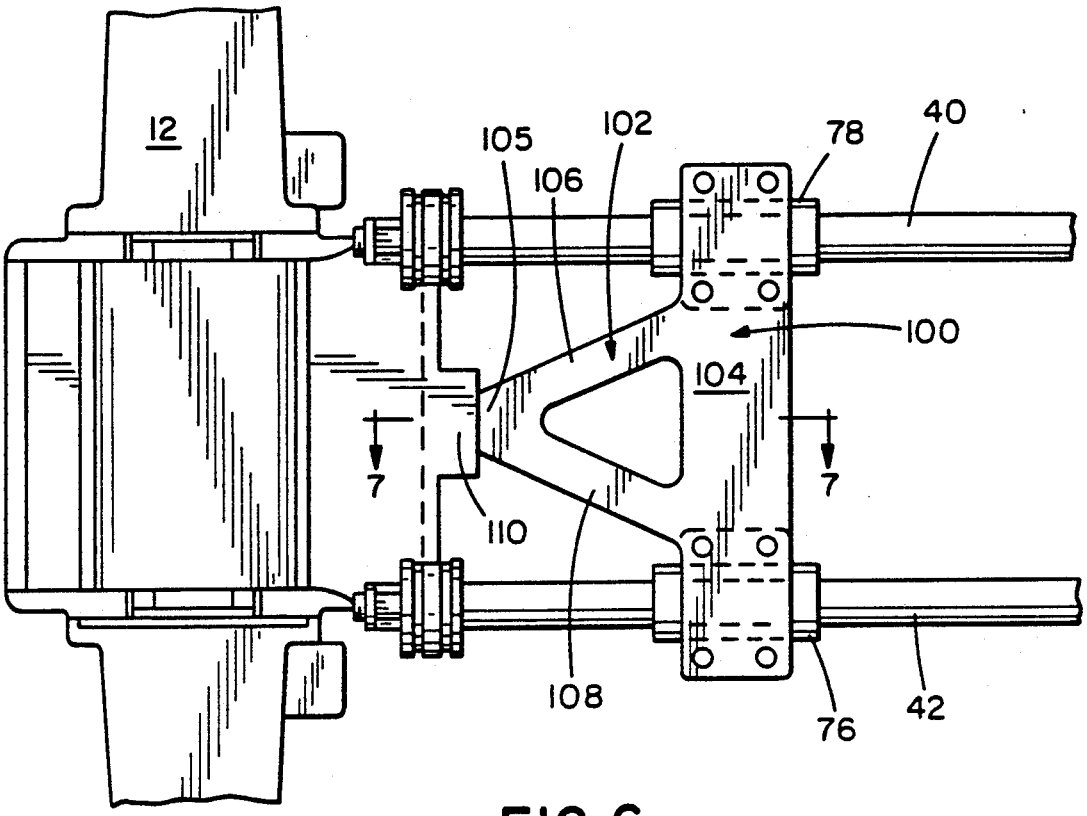
FIG. 6
FIG. 7
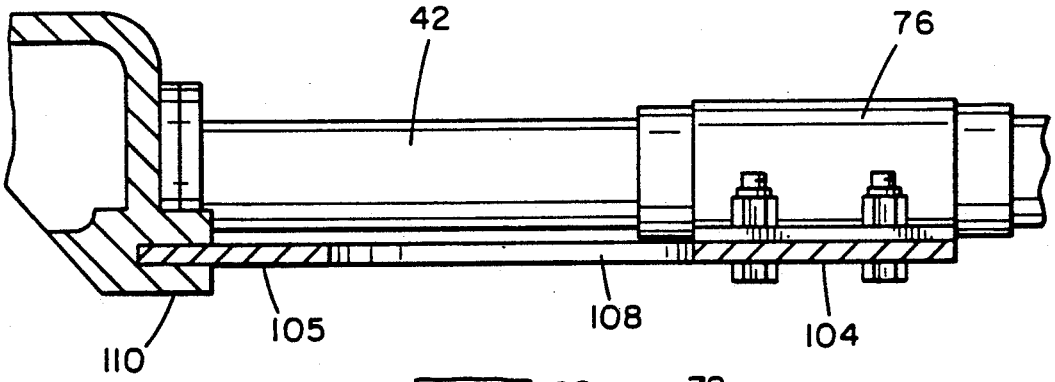
FIG. 5B
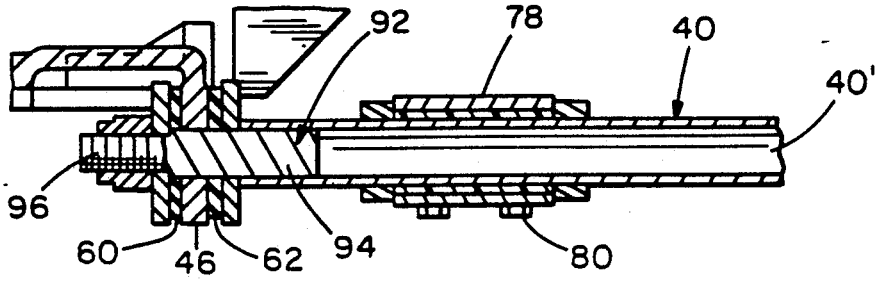

STABILIZED SWING-MOTION TRUCK FOR RAILWAY CARS

BACKGROUND OF THE INVENTION

The present invention is directed to an improvement of the swing-motion truck disclosed in U.S. Pat. No. 3,670,660-Weber, et al. The conventional swing-motion truck disclosed in the above-identified patent has proven extremely successful and has provided a degree of operating efficiencies not previously achieved. The conventional swing-motion truck was designed to lower the critical speeds at which periodic track disturbances could cause resonance conditions with the sprung car body, and, therefore, uncontrolled car body hunting. At low critical speeds, resonance can be effectively controlled by the damping mechanism of the truck, avoiding uncontrolled hunting. The hunting phenomenon causes excessive wear on the wheel flanges and the ultimate problem of derailing and toppling of the car itself. The swing-motion truck disclosed in said patent decouples the lateral movement and forces of the axle and truck side frames from the truck bolster and the car body, thereby substantially isolating the transverse or lateral forces impinging on the wheels and side frames, arising either from rail irregularities or the hunting phenomenon itself, such swing-motion truck providing a dual range of lateral suspension stiffness or rigidity, as completely set forth in said patent. One of the important features of the conventional swing-motion truck is the unique support and load transfer of the car body and lading via its center plate and the transverse truck bolster to the side frames of the truck. This was achieved by a transverse platform or transom spanning laterally across the width of the truck, each end of the transom being supported on a respective rocker seat and held in alignment via a plurality of upstanding bosses received in apertures formed in the ends of the transom proper. The rocker seats allow for the relative transverse swinging of the respective side frames to achieve the decoupling of the transverse lateral forces of the truck from impacting directly upon the truck bolster and the car body, the rocker seats also providing a limit stop in either angular direction to the movement of the respective side frame, which, in the preferred embodiment disclosed therein, is three degrees in either direction, which allows for lateral translation of the bolster in either direction of approximately ⅝ of an inch. Such limit stops define the end of the first stage of resistance to the lateral movement of the side frames, thereafter the second stage coming into play, which second stage provides a considerably greater resistance, which is achieved by the opposition to the lateral movement of the bolster via the lateral deflections of the load spring groups, which resiliently support the ends of the truck bolster and, therefore, the car body. The degree of resistance to lozenging movement of the side frames and axles relative to the truck bolster is also directly dependent upon the weight of the car body, and whether it is in its loaded or unloaded state. This is directly attributable to the fact that the transverse connecting transom is interconnected with the rocker seats via the above-described apertures and upstanding bosses, so that the rigidity against lozenging of the truck itself, including the two axle sets thereof, the pair of swing-mounted side frames thereof, as well as the pair of side-frame rocker seats, is directly affected by the weight of the car body itself, as well as the load thereof, since the interconnection between the two opposite side frames of the truck proper is via the pair of rocker seats and the transverse transom, which interconnect via the frictional contact therebetween. Additional problems arise in the rigidity of the truck during wear and tear of the truck proper, in that the upstanding bosses received within the apertures of the transom allow for a certain amount of play or relative pivotal movement between transom and rocker seat, which play, over time, increases the greater the wear and tear, further compromising the rigidity of the truck structure, and tending to increase the amount of lozenging of the truck elements, or parallelogramming. The total resistance to lozenging of the truck is dependent upon a few factors, such as the resistance of the friction wedges cooperating with the inclined rear surfaces and vertical side walls of the bolster wedge pockets and the vertical columns of the side frames, the resistance of the adapter side- frame interfaces against rotation, and the above-mentioned frictional resistance against relative movement between the transom-rocker seat interface, which as described above, depends upon the weight carried by the truck, and specifically the car body itself. However, with the advent of much lighter weight cars, as well as a need for lower height, or what are termed lower-deck, cars, the portion of the resistance to lozenging in the swing-motion truck attributable to the transom-rocker seat interface has been compromised by the very fact that these cars are of lighter weight. Thus, after considerable wear and tear, and when the trucks are being operated at high speeds, the tendency to lozenging is an ever-present possibility, which would not only lead to unstable primary or car body hunting, but also pose a considerable hazard of secondary or truck hunting which would occur at high speeds resulting in excessive forces on wheel and axles and truck and car body. Thus, in summary, the trend toward lighter weight and low-deck car bodies tends to diminish the operating efficiencies of the conventional swing-motion truck.

It is the objective of the present invention to overcome these deficiencies, and to ensure that lozenging of the truck proper does not occur during high-speed operations, which is achieved by rigidizing the truck to prevent parallelogramming, as well as to provide the highly-effective attributes of the swing motion truck for the prevention of uncontrolled resonance and primary or car body hunting, as well as to ensure that secondary or truck hunting is not experienced even at very high operating speeds.

SUMMARY OF THE INVENTION

It is, therefore, the primary objective of the present invention to provide an improved swing-motion truck in which the transom thereof is replaced with rigid radius, or transverse, rods interconnecting the parallel side frames of the truck.

It is another objective of the present invention to couple the ends of these radius rods directly to the rocker seats associated with the tension member of the side frames directly, in order to provide a semi-rigid connection therebetween.

It is yet another objective of the present invention to provide for the lateral bolster stop to interface with a like lateral stop to prevent the excessive movement of the bolster relative to the side frames by providing a lateral stop on the rocker seat itself.

It is still another objective of the present invention to increase stabilization of the truck by providing at least a pair of cross stabilizers interconnecting the pair of parallel radius rods interconnecting diametrically-opposed rocker seats together, whereby increase rigidization and opposition to lozenging ensues.

It is an objective of the present invention to provide such a improved swing-motion truck that is capable of use with car bodies of conventional height, as well as with car bodies of lower height, or what are called low deck bodies, such being able to be accomplished, since the hitherto-used transoms are no longer employed, thereby the thicknesses thereof not adding to the overall height of the truck proper, whereby lower overall heights, or low deck cars, may be provided.

BRIEF DESCRIPTION OF THE DRAWING

The invention will be more readily understood with reference to the accompanying drawings, wherein:

FIG. 5B is a cross-sectional view similar to FIG. 5A but showing a modification of the radius rods of the invention;

FIG. 6 is a bottom view showing the pair of radius rods connected to a rocker seat and interconnected via a second embodiment of a cross stabilizer for increasing the stiffness in the horizontal plane;

FIG. 7 is a cross-sectional view taken along line 7—7 of FIG. 6;

DETAILED DESCRIPTION OF THE INVENTION

Figure 1:
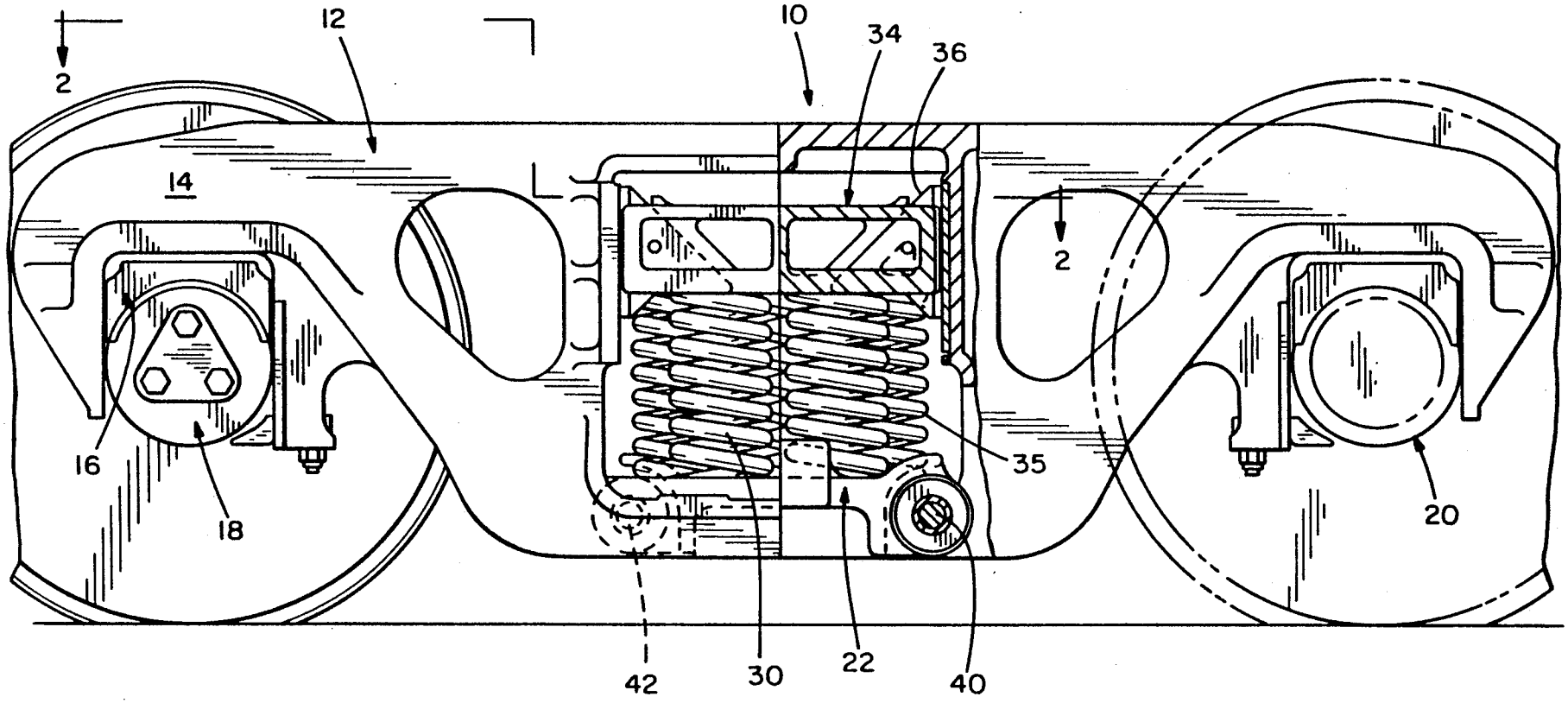
FIG. 1 is a side view of a side frame of the improved swing-motion truck, according to the invention, in partial cross section.
Figure 3:
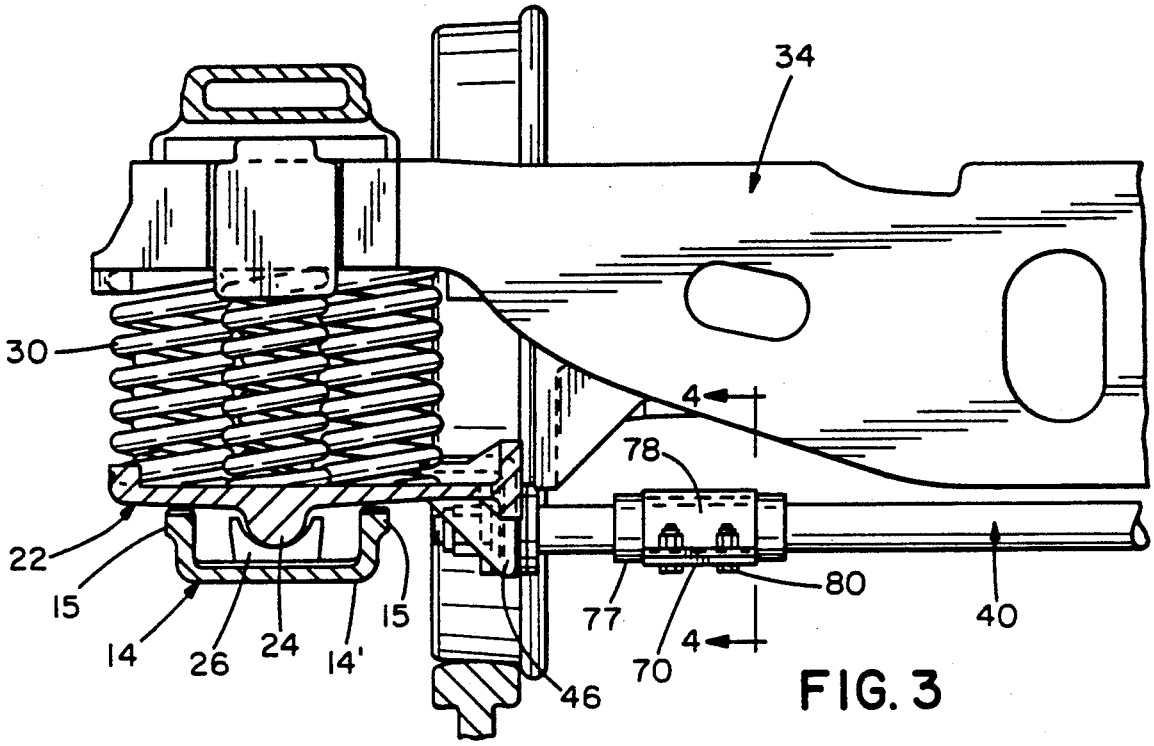
FIG. 3 is an end view, in cross section, showing the rocker bearing connection of the tension member of the side frame, and its coupling to a radius rod of the improved swing-motion truck of the invention, with the radius rods interconnected by a cross-stabilizing element.
Figure 4:
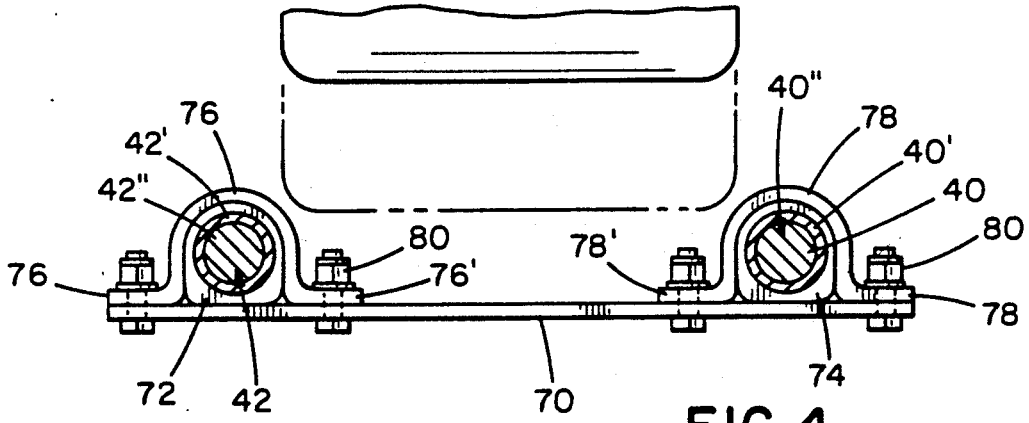
FIG. 4 is a cross-sectional view taken along line 4—4 of FIG. 3.

Referring now to the drawings in greater detail, the improved swing-motion truck of the invention is indicated generally by reference numeral 10. The truck 10 includes a pair of parallel side frames 12, as disclosed in U.S. Pat. No. 3,670,660. Each side frame 12 operates as a swing hanger, and has a forward end 14 swingingly mounted on a bearing adapter 16 of an axle-set 18 in the conventional swing-motion truck manner. The rearward end of the side frame 14 is mounted in similar fashion to the rear axle-set 20. The central or middle portion of each side frame 12 is also relatively, rockingly mounted with respect to a rocker-seat 22, as shown in FIG. 3, the rocker-seat defining a downwardly-projecting, convex-shaped bearing surface 24 which is received in a concave-shaped bearing 26 provided on the tension member of the side frame 12. The side-frame rocker-seat also provides a lower spring-seat for the suspension and control springs, the upper ends of which suspension springs support a respective end of the transverse bolster of the truck. The suspension springs are indicated generally by reference 30 in FIG. 1, the lower ends of which are supported directly upon the upper flat surface face of the rocker seat 22, as clearly shown in FIGS. 1 and 3, which contrasts with the mounting in the above-identified patent, where the lower ends of the suspension springs are in contact with an upper surface of an end of a transom supported on the rocker seat, all of which are for the purposes intended according to the invention. In the conventional fashion, the side-frame's tension member 14' is allowed an approximately three-degree angular transverse rotation or swinging, the limits of which are defined by the contacts of the upstanding members 15 against the corresponding, juxtapositioned, lower surface portions of the rocker seat 22, up to which point the first, lower degree of resistance against side frame swing prevails. The upper ends of the springs 30 support and suspend the respective end of the transverse truck bolster 34, while the control spring 35 biases a wedge block 36 upwardly, in a conventional manner. The rocker-seat interface with the bearing 26 is located at a lower elevation as compared with the rocker-seat adapter bearing relationship at the ends of the side frame, in order to ensure the pendulum-like swinging motion of the side frame, as set forth in the above-identified patent.

Figure 2:
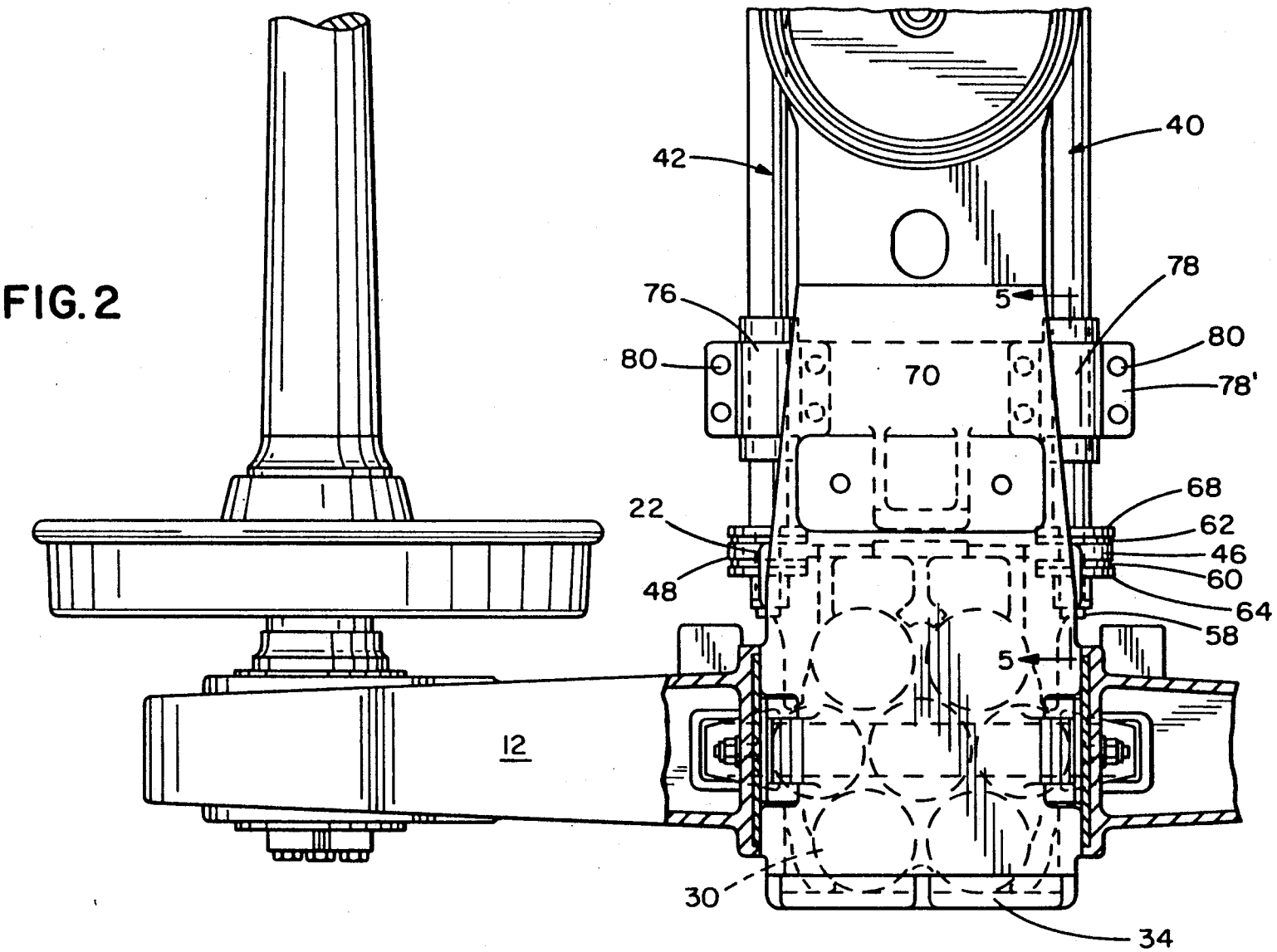
FIG. 2 is a cross-sectional view taken along line 2—2 of FIG. 1.

As described above, the present invention has eliminated the transom interconnection employed by the conventional swing-motion truck, and has supported the lower ends of the suspension springs 30 directly on the upper surface face of the rocker-seat 22. Replacing the transom, according to the present invention, are, in the preferred embodiment, two transverse support or radius rods 40, 42, which rigidly interconnect the parallel side frames of the improved swing-motion truck by directly interconnecting the two rocker-seats 22 thereof, as described below in greater detail. Each rocker-seat 22 defines two anchor-brackets 46, 48, as shown in FIGS. 2 and 3, each anchor-bracket defining an opening through which passes an end portion of a respective radius rod 40, 42 for securement to the rocker-seat. Each anchor-bracket 46, 48 extends substantially vertically downwardly from the substantially horizontal rocker-seat 22, the two anchor-brackets 46, 48 being spaced apart in the fore and aft direction, parallel to the longitudinal center line of the transverse-located truck bolster. The rocker-seat proper 22 also is provided with a vertical abutment-surface 50, as seen in FIGS. 3 and 5, which cooperates with a similar vertical stop 52 provided on the undersurface of the truck bolster 34, the vertical surface 50 constituting a lateral stop to the transverse movement of the truck bolster 34, the vertical lateral stop 50 thus performing the task carried out by a similar lateral stop provided on the transom of the conventional swing-motion truck. Typically, the normal distance between two stops 50 and 52 is ⅝ of an inch, which ⅝ of an inch is added to the approximate ⅝ of an inch of travel of the bolster during the first, low-resistance stage due to movement of the side frame, as disclosed in the above-described patent.

Figure 5A:
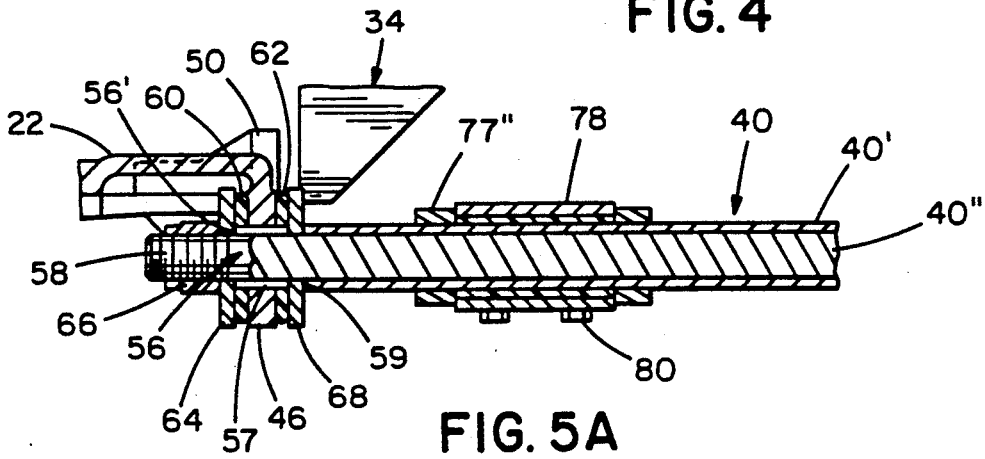
FIG. 5A is a cross-sectional view taken along line 5—5 of FIG. 2.

Referring back now to the connection of the radius rods 40, 42 to the rocker-seats, the connection at each end of the radius rod is clearly shown in FIG. 5A. In the preferred embodiment, the radius rods 40, 42 include a main, elongated outer tubular portion 40', 42', respectively, spanning most of the distance between diametrically-opposed rocker-seats of the two side frames, on opposite ends thereof. Telescopingly-received in the hollow tubular portions or members 40', 42' are solid rod members 40'', 42'' each having a length greater than that of the tubular members 40', 42', so that each radius rod defines two projecting end portions 56 of smaller diameter than the tubular member 40', 42', and two first annular shoulders 59. The projecting end portions are comprised of an inner section and an outer section for purposes of description, with the inner section receiving thereabout an inner washer 68 and a short hollow sleeve member 57 having an outer diameter less than that of the hollow tubular member 40', 42'. The sleeve member 57 is of shorter length than the entire projecting end portion 56 of the respective radius rod, in order to define a second annular shoulder 56', with the outer section 58 of the end portion 56 of the radius rod extending outwardly therepast. The hollow sleeve member 57 is received within the opening of the respective anchor bracket 46, with a pair of elastomeric pads 60, 62 sandwiching the anchor bracket 46 therebetween. The outer section 58 of the end portion 56 of the radius rod is threaded, and concentrically mounts an outer washer 64 as well as a lock nut 66 for securing the end of the radius rod to the respective anchor bracket of the rocker seat, there also being provided a previously-mentioned inner washer 68 about the exterior end portion of the solid rod member 40'', all of which is clearly shown in FIG. 5A. The elastomeric pads or rings 60, 62 provide the semi-rigid connection of the side frames through the rocker seats, as well as prolonging the life of the parts thereof, such pads or rings being compressed between the two washers 64 and 68, via the nut 66, the maximum allowed to such compression being determined by the length of the spacer sleeve 57 which is mounted between inner and outer washers 68 and 64, whereby damage to the elastomeric rings is prevented. It may, therefore, be seen that the replacement of the transom of the above-described patent with the radius rods hereinabove disclosed, does away with any kind of need for frictional dependencies for the non-lozenging of the truck and the parallelogramming of the side frames thereof. In the preferred embodiment, each of the washers or steel plates 64, 68 is a circular in cross section, with an outer diameter of 4 ½ inches, and an inner diameter of 1 9/32 inches. Each elastomeric pad or ring has an outer diameter of 4 inches and an inner diameter of 2 inches. Each elastomeric pad or ring is made of 75 Durometer natural rubber, while each steel plate or washer is made of AISI 1030 steel, and weighs approximately three pounds.

The improved swing-motion truck is also provided with a horizontal cross-stabilizer element best seen in FIGS. 3 through 5A. In the preferred embodiment, the cross-stabilizer is a flat, horizontal plate 70 interconnecting the two radius rods 40, 42 along the approximate midportions thereof, as best seen in FIGS. 2 and 5A. The two ends of the cross-stabilizer plate 70 are secured to the respective radius rods 40, 42 by elastomeric bushings 72, 74, and by a pair of metal brackets 76, 78, which are wrapped about the elastomeric bushings and secured directly to the cross-stabilizer plate by bolts 80 via the bracket arm extensions 76', 78', best seen in FIG. 4. Secured tightening of the outer metal brackets 76 and 78 compress the elastomeric bushings 72 and 74 to thus provide a cushioned and semi-rigid connection between the radius rods. In order to prevent relative sliding movement between the radius rods and the cross-stabilizer with bracket and attachments, there are also provided a pair of collars 77'' on either side of the respective bracket attachment, positioned on the respective radius rods, for preventing such relative sliding movement, each of the brackets being fixedly secured to the respective radius rod in a conventional manner. Preferably, such collars are fastened to the radius rods via a shrink fit. It is, however, within the scope and purview of the present invention to provide an improved swing-motion truck not incorporating the cross-stabilizers hereinabove described, for operations where the radius rod connections to the anchoring brackets of the rocker-seats are deemed to be suitable to prevent lozenging, and for uses where high-load capacity operations are not encountered.

FIG. 5B shows a slight modification of the radius rods of the invention, in which instead of an elongated inner core 40'', 42'', and the pair of hollow sleeve members 57, there are provided a pair of individual, short, stepped end-members 92. Each end-member defines a first interior portion 94 telescopingly received in an end of the outer hollow tube 40', and a second, exterior portion 96 that is threaded, whereby two integral annular shoulder surfaces are provided, as in the preferred embodiment, but without the help of the spacer sleeve, and whereby the two elastomeric pads and two washers are used to mount the radius rod to the rocker seat, with the inner washer having a larger inside diameter to fit over the larger diameter of end members 92.

FIGS. 6 and 7 show a modification of the cross-stabilizer, and is indicated generally by reference numeral 100. The cross-stabilizer is similar to that of the preferred embodiment, with the slight modification of the addition of a center-brace member 102 that is substantially isosceles triangular in shape, with the base thereof being part of the main horizontal connecting portion 104. The apex 105 at the juncture of the two legs 106, 108 of cylindrical shape is received in an opening formed as a hollow cylinder in a central support member 110 forming part of the rocker seat. Specifically, the member 110 is part of an elongated, longitudinal support plate at the ends of which are formed the two anchor-brackets 46, as above-described, for mounting the ends of the radius rods to the rocker seats. This modification provides greater overall stability.

Figure 8:
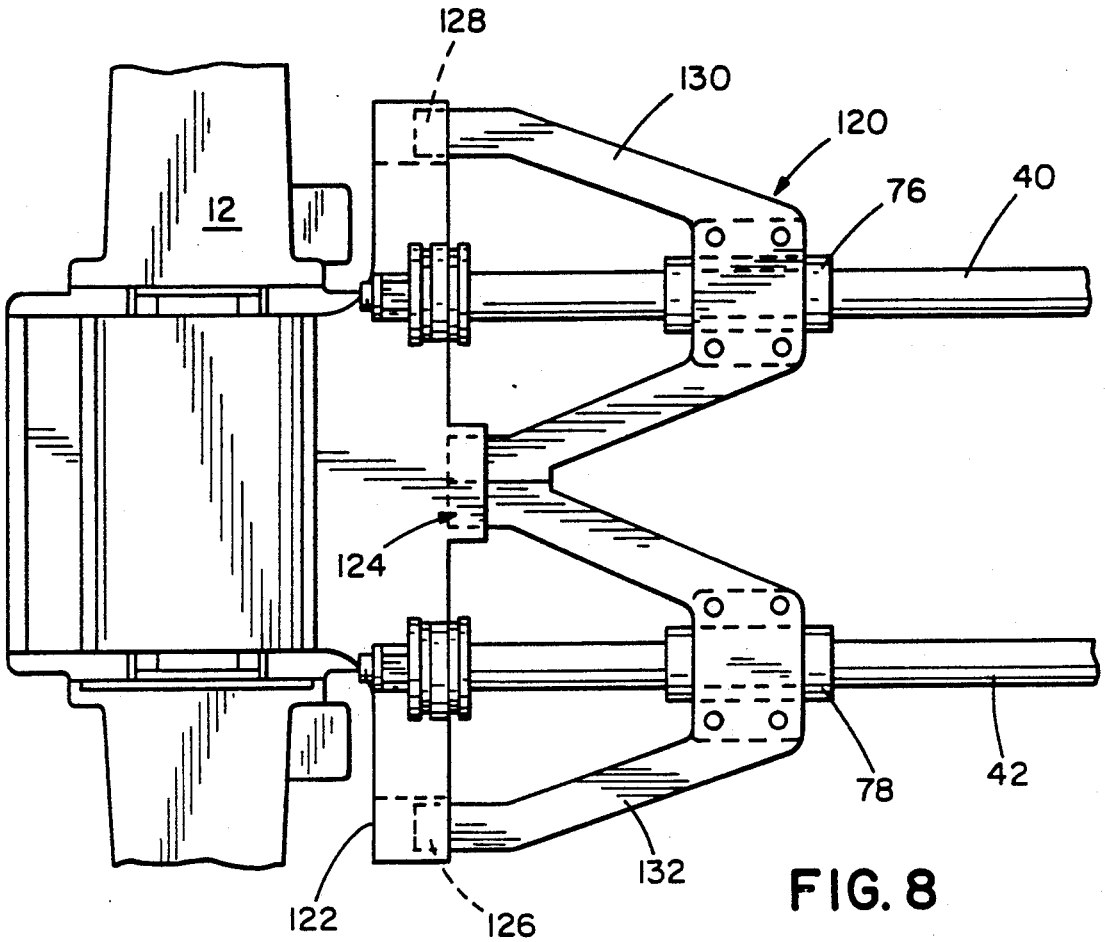
FIG. 8 is a bottom view similar to FIG. 6, but showing a third embodiment of the cross stabilizers for increasing the horizontal stability of the transverse radius rods.

FIG. 8 is yet another modification of the cross-stabilizer, and is indicated generally by reference numeral 120. In this modification, the rocker seat is provided with a lower plate extension 122 in which is formed the two anchor-brackets 46 above-described, as well as a center opening 124, and a pair of end-openings 126, 128. The cross-stabilizer 120 consist of two like halves 130, 132. The two ends of the first half 132 are received in the opening 126 and half of the center opening 124, while the ends of the other half 130 are received in the opening 128 and the other half of the center opening 124, as clearly shown in FIG. 8.

Figure 9:
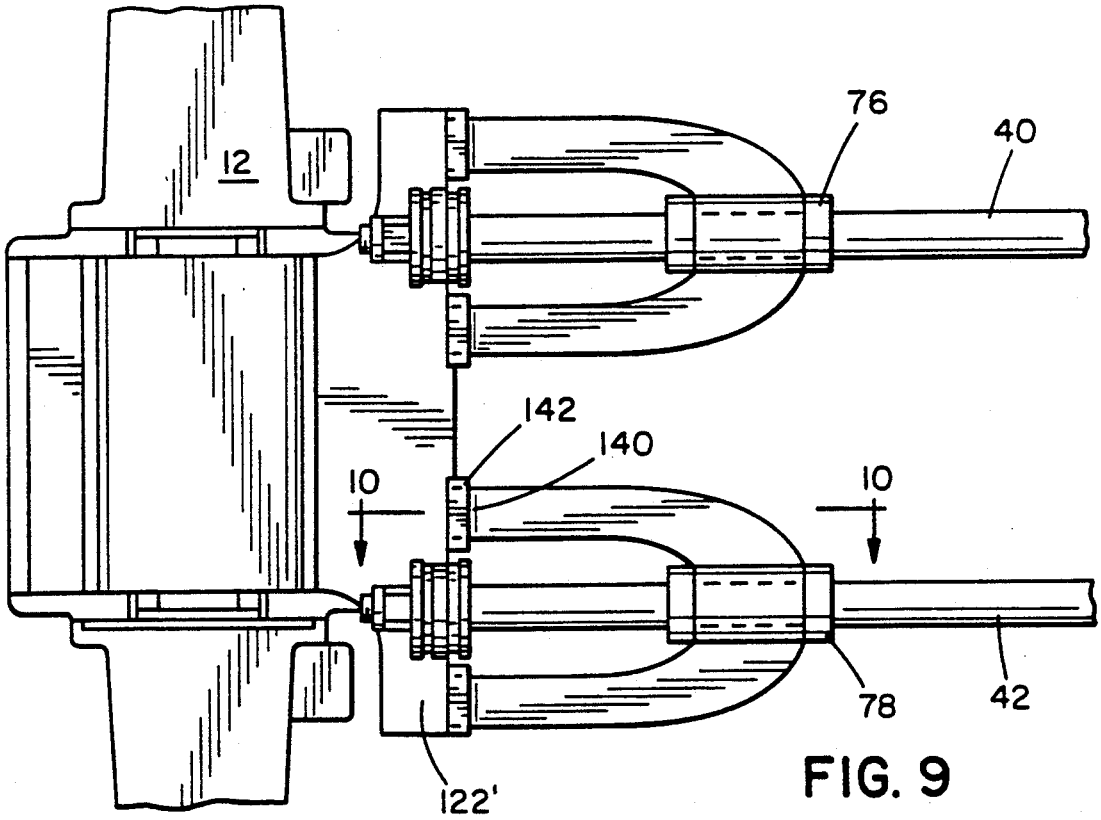
FIG. 9 is a bottom view similar to FIG. 8, but showing a fourth embodiment of the cross stabilizers for the radius rods.
Figure 10:
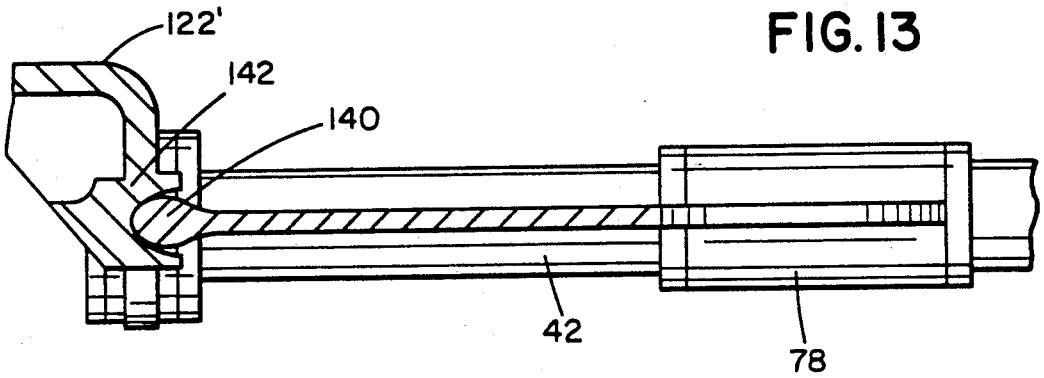
FIG. 10 is a cross-sectional view taken along line 10—10 of FIG. 9.

Still another modification of the cross-stabilizer is shown in FIGS. 9 and 10 which is similar to that of FIG. 8, with the difference being that each half has its ends secured to the rocker-seat plate 122' via openings formed completely on the same side, with each end being received in its own opening, as clearly shown FIG. 9. In this modification, each end of the each half of the cross-stabilizer is provided with a sphere-type projection 140, as shown in FIG. 10 which fits into a socket-type opening 14 in order to allow pivotal play between the cross-stabilizer and the rocker seat.

Figure 11:
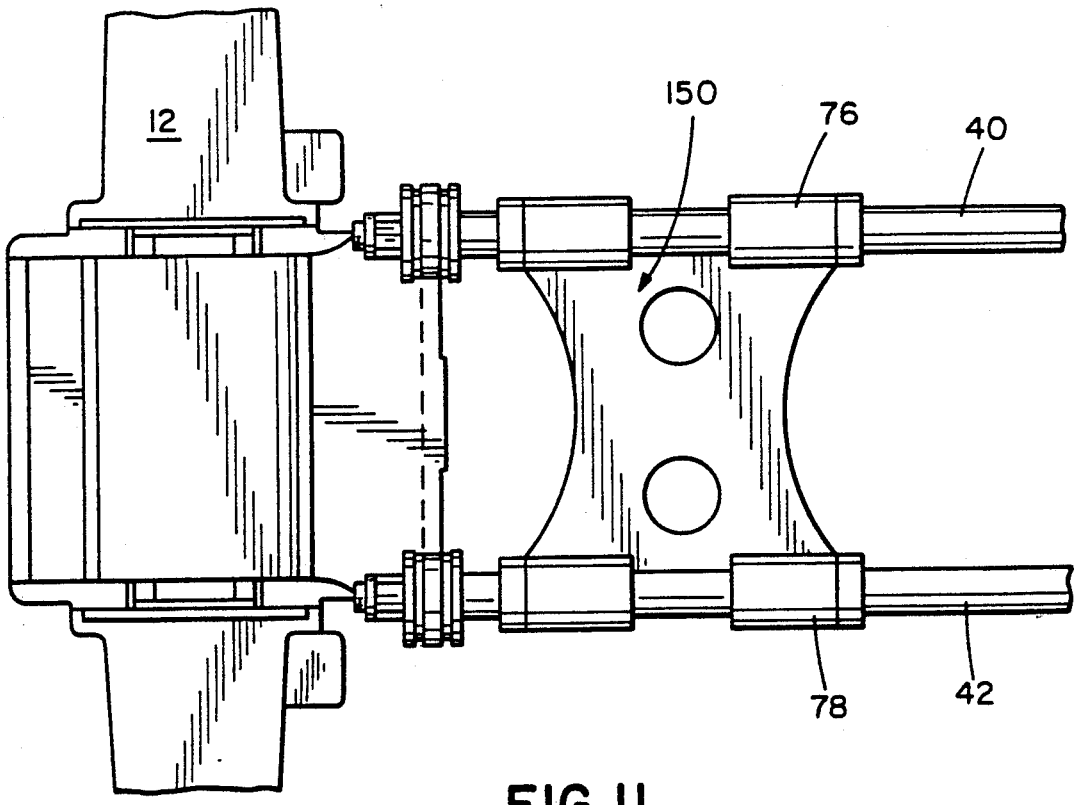
FIG. 11 is a fifth embodiment of the cross stabilizer for increasing the horizontal stability of the pair of parallel transverse radius rods of the improved swing-motion truck of the invention.

FIG. 11 shows another modification of the cross-stabilizer 150 in which there are provided two connections at each end of the cross-stabilizer for coupling to a respective radius rod.

Figure 12:
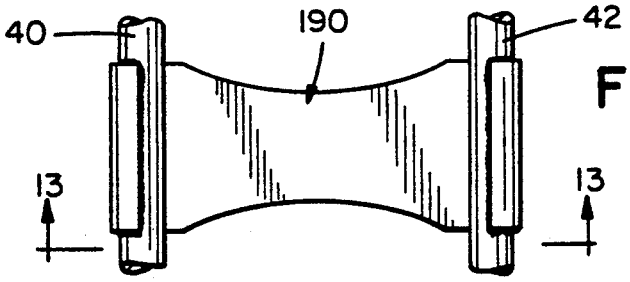
FIG. 12 is a plan view of a sixth embodiment of the cross stabilizer which is welded to the respective radius rods.
Figure 13:
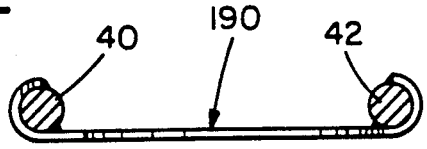
FIG. 13 is a cross-sectional view taken along line 13—13 of FIG. 12.

FIGS. 12 and 13 show another modification of the cross stabilizer 190 where the ends thereof are welded to the center portions of the two radius rods.

While a specific embodiment of the invention has been shown and described, it is to be understood that numerous changes and modifications may be made therein without departing from the scope, spirit and intent of the invention as set forth in the appended claims.

WHAT WE CLAIM IS:

1. In a railway-car truck comprising a first side frame and a second side frame, a pair of wheel-axle sets with each of said first and second side frames being swingingly coupled to said pair of axle sets on one lateral side of said pair of wheel-axle sets, said first side frame being disposed on one lateral side and said second side frame being disposed on the other lateral side of said truck, each of said first and second side frames comprising a tension member and an intermediate section having a bolster-receiving opening for receiving an end portion of a truck bolster and for housing the suspension and control springs operatively associated with a truck bolster end-portion, each said tension member having an intermediate portion, each of said first and second side frames also comprising a rocker seat having an upper surface face, said intermediate portion of each said tension member comprising means for rockably supporting a respective said rocker seat, whereby said first and second side frames are mounted for lateral swinging movement, and means for coupling said first and second side frames together, wherein the improvement comprises:

said means for coupling said first and second side frames together comprises at least one tie rod having a first end fixedly coupled to said rocker seat of said first side frame, and a second end fixedly coupled to said rocker seat of said second side frame, whereby a semi-rigid connection between side frames is achieved; and means for securing said first and second ends to the respective said rocker seats.

2. The improvement according to claim 1, wherein each said rocker seat comprises at least one anchoring extension to which a respective said first and second end is connected.

3. The improvement according to claim 2, wherein said means for coupling comprises two said tie rods substantially parallel to each other, and each said rocker seat comprises a pair of said anchoring extensions, one said anchoring extension projecting inwardly from a forward portion of the respective said rocker seat, and one said anchoring extension projecting inwardly from a rearward portion of the respective said rocker seat; said pair of tie rods being spaced apart in the longitudinal axial directions, the first and second ends of one said tie rod being coupled to said forwardly projecting anchoring extensions of said pair of rocker seats, and the first and second ends of the other said tie rod being coupled to said rearwardly projecting anchoring extensions of said pair of rocker seats, whereby lozenging is prevented.

4. The improvement according to claim 2, wherein said means for securing said first and second ends comprises a first pair of elastomeric pads telescopingly mounted about said first end, and a second pair of elastomeric pads telescopingly mounted about said second end, said first pair of elastomeric pads sandwiching therebetween said anchoring extension of said rocker seat of said first side frame, and said second pair of elastomeric pads sandwiching therebetween said anchoring extension of said rocker seat of said second side frame.

5. The improvement according to claim 4, wherein each of said first and second ends comprises a threaded portion for passing through the respective said anchoring extension, said means for securing further comprising a first pair of washers for said first end, and a second pair of washers for said second end, each said pair of washers sandwiching therebetween a respective said pair of elastomeric pads for the compressing thereof, and a pair of lock nuts for respective engagement with said threaded portions of said first and second ends of said tie rod; each said anchoring extension having a through-opening through which passes a respective said first and second end.

6. The improvement according to claim 4, wherein said means for coupling comprises two said tie rods substantially parallel to each other, and each said rocker seat comprises a pair of said anchoring extensions, one said anchoring extension portion projecting inwardly from a forward portion of the respective said rocker seat, and the other said anchoring extension projecting inwardly from a rearward portion of the respective said rocker seat; said pair of tie rods being spaced apart in the longitudinal axial directions, the first and second ends of one said tie rod being coupled to said forwardly projecting anchoring extensions of said pair of rocker seats, and the first and second ends of the other said tie rod being coupled to said rearwardly projecting anchoring extensions of said pair of rocker seats, whereby lozenging is prevented.

7. The improvement according to claim 2, wherein each said anchoring extension projects substantially vertically downwardly so as to be positioned below said upper surface face of the respective said rocker seat.

8. The improvement according to claim 1, in combination with a railway-car truck bolster comprising a first end portion housed in said bolster-receiving opening of said first side frame, and a second end portion housed in said bolster-receiving opening of said second side frame, a first series of suspension springs housed in said bolster-receiving opening of said first side frame, and a second series of suspension springs housed in said bolster-receiving opening of said second side frame, each spring of each of said first and second series of suspension springs having a lower end and an upper end, each said upper end of said springs of said first and second series contacting against a respective said end portion of said truck bolster, and each said lower end of said springs of said first and second series directly resting upon said upper surface face of the respective said rocker seat, whereby the overall height of the truck-railway car combination is reduced.

9. The improvement according to claim 3, further comprising cross-stabilizer means interconnecting said two tie rods together at approximately corresponding intermediate sections of said two tie rods, said cross-stabilizing means extending substantially in the longitudinal direction substantially transverse to the lengths of the tie rods, whereby increased stiffness to parallelogramming is achieved.

10. The improvement according to claim 2, wherein each said rocker seat further comprises a vertical lateral-stop surface projecting laterally inwardly for cooperation with a lateral stop surface on a truck bolster operatively associated therewith for limiting the relative lateral movement of a truck bolster with respect to the side frames.

11. The improvement according to claim 2, wherein each of said first and second ends of said at least one tie rod comprises a first step-down portion of smaller size than the intermediate section of said tie rod, and a second step-down portion of smaller size than said first step-down portion, said first step-down portion being located laterally inwardly of said second step-down portion, said first step-down portion defining a first shoulder at its juncture with the intermediate portion of said tie rod, and said second step-down portion defining a second shoulder at its juncture with said first step-down portion; said first shoulder being located laterally inwardly, toward the center of the tie rod of the respective said anchoring extension of the respective said rocker seat associated therewith, and said second shoulder being located laterally outwardly, toward the end of the tie rod, of the respective said anchoring extension of the respective said rocker seat associated therewith.

12. The improvement according to claim 11, wherein said means for securing said first and second ends comprises a first pair of elastomeric pads for said first end, and a second pair of elastomeric pads for said second end, said first pair of elastomeric pads sandwiching therebetween said anchoring extension of said rocker seat of said first side frame, and said second pair of elastomeric pads sandwiching therebetween said anchoring extension of said rocker seat of said second side frame.

13. The improvement according to claim 12, wherein each of said first and second pairs of elastomeric pads is concentrically mounted about the respective said first step-down portion of the respective one of said first and second ends.

14. The improvement according to claim 13, wherein each of said first and second ends comprises a threaded portion forming at least part of said second step-down portion passing through the respective said anchoring extension, said means for securing further comprising a first pair of washers for said first end, and a second pair of washers for said second end, each said pair of washers sandwiching therebetween a respective said pair of elastomeric pads for the compressing thereof, and a pair of lock nuts for respective engagement with said threaded portions of said first and second ends of said tie rod; each said anchoring extension having a through-opening through which passes a respective said first and second end; one said washer of each said pair of washers abutting against a respective said first shoulder, and the other said washer of each said pair of washers abutting against a respective said second shoulder.

15. The improvement according to claim 1, wherein said means for rockably supporting said rocker seat comprises a concave bearing surface having a first radius of curvature, and said rocker seat comprises a convex bearing surface having a second radius of curvature for seating in said concave bearing surface; said first radius of curvature being greater than said second radius of curvature in order to ensure the swinging mounting of the respective said side frame.

16. The improvement according to claim 3, wherein each of said two tie rods comprises an outer, elongated hollow member, a longer, elongated inner rod member comprising a first and a second threaded end each defining at least a portion of said first and second ends of said tie rod, said inner rod member passing entirely through said outer hollow member in telescoping manner, such that said first and second threaded ends of said rod member project laterally outwardly beyond the respective end of the said elongated hollow member; and a pair of hollow spacers telescopingly positioned about said first and second ends of said tie rod, one said hollow spacer for one said first and second end of said tie rod, each said spacer having a length less than the length of the respective said first and second threaded ends of said rod member, each said hollow spacer having a diametric extent less than that of said elongated hollow member and greater that of said rod member, whereby each of said first and second ends of said tie rod has two step-down portions to define a pair of vertical shoulder surfaces.

17. The improvement according to claim 16, wherein each of said hollow member and said rod member, and each said hollow spacer is of circular cross-section; each said hollow spacer being received in a through-opening of a respective said anchoring extension.

18. The improvement according to claim 17, wherein said means for securing said first and second ends comprises a first pair of elastomeric rings telescopingly mounted about one said hollow spacer, and a second pair of elastomeric rings telescopingly mounted about the other said hollow spacer, said first pair of elastomeric rings sandwiching therebetween said anchoring extension of said rocker seat of said first side frame, and said second pair of elastomeric rings sandwiching therebetween said anchoring extension of said rocker seat of said second side frame.

19. The improvement according to claim 18, wherein said means for securing further comprises a first pair of washers for said first end, and a second pair of washers for said second end, each said pair of washers sandwiching therebetween a respective said pair of elastomeric pads for the compressing thereof, and a pair of lock nuts for respective engagement with said threaded portions of said first and second ends of said rod member, one said lock nut for one said first and second end of each said tie rod.

20. A radius or tie rod for semi-rigidly coupling a pair of side frames of a railway-car truck, comprising:

an elongated, intermediate main body portion;

a first end portion;

a second end portion;

each of said first and second end portions comprising a first step-down section of less diametric extent than said intermediate main body portion, and a second step-down section of less diametric extent than said first step-down section;

said second step-down section being located outwardly of said first step-down section and farther away from said intermediate main body portion than said first step-down section;

said first step-down section defining with the end of said intermediate portion a first shoulder surface, and said second step-down section defining with said first step-down section a second shoulder surface, whereby said first and second step-down sections and said first and second shoulder surfaces are used for securing the radius rod to a rocker seat of a frame of a railway-car truck;

said intermediate main body portion comprising an elongated hollow member and an elongated rod member telescopingly received in said hollow member;

said elongated rod member having a length greater than the length of said hollow member; said rod member having a first end projecting outwardly beyond one end of said hollow member to define at least part of said first end portion of the radius rod, and a second end projecting outwardly beyond the other end of said hollow member to define at least part of each said second step-down section being the outward portion of the respective said first and second end of said rod member projecting outwardly of the respective said hollow sleeve member.

21. The radius or tie rod according to claim 20, wherein said rod member, said hollow member, and each said sleeve members comprises a circular cross section, the diameter of said hollow member being greater than the diameters of said rod member and said sleeve members, and the diameter of each said sleeve member being greater than the diameter of said rod member.

22. The radius or tie rod according to claim 20, wherein each of said first and second end portions comprises a pair of elastomeric elements, each said pair of elastomeric elements being spaced apart and telescopingly mounted about a respective said first step-down section, whereby each said pair of elastomeric elements sandwiches therebetween a projection of a rocker seat of a side frame of a railway-car truck to which the respective said end portion of the radius rod is coupled.

23. The radius or tie rod according to claim 22, in combination with a pair of rockers seats used With a pair of side frames of a railway-car truck; each said rocker seat comprising a main portion and a mounting means for coupling to a respective one of said first and second end portions; each said mounting means being telescopingly received about a portion of a respective said first step-down section and sandwiched between a respective pair of said elastomeric elements; each said mounting means comprising an opening through which passes said portion of the respective said first step-down section.

24. The radius or tie rod according to claim 23, wherein each said mounting means comprises a bracket projecting from said main portion, and a first washer in abutment against said first shoulder surface, and a second washer in abutment against said second shoulder face, and a nut, said second step-down section having a threaded portion for mating engagement with said nut, whereby said nut retains said second washer against said second shoulder to thereby limit the compression of said elastomeric elements.

25. The radius or tie rod according to claim 24, comprising two said radius rods arranged substantially parallel to each other, each said radius rod having a length taken from said first end portion to said second end portion, each said rocker seat having two said mounting means spaced apart from each other in a direction transverse to the lengths of said radius rods, one said mounting means coupled to one of said first and second end portions of one of said radius rods, and the other said mounting means coupled to the like end portion of the other of said radius rods.

26. The radius or tie rod according to claim 25, further comprising cross-stabilizing means comprising a first end and a second end coupled between said intermediate portions of said two radius rods, said cross-stabilizing means extending transversely to the lengths of said two radius rods, and means for connecting the first and second ends of said cross-stabilizing means to respective ones of said intermediate portions.

27. The radius or tie rod according to claim 26, wherein said means for connecting the first and second ends comprises welds.

28. A method of rigidizing a railway-car truck, which truck has a first side frame and a second side frame, a pair of wheel-axle sets with each of said first and second side frames being swingingly coupled to said pair of axle sets on one lateral side of said pair of wheel-axle sets, said first side frame being disposed on one lateral side and said second side frame being disposed on the other lateral side of said truck, each of said first and second side frames comprising a tension member and an intermediate section having a truck bolster-receiving opening for receiving an end portion of a truck bolster of a railway car truck and for housing the suspension and control springs operatively associated with a truck bolster end-portion, each said tension member having an intermediate portion, each of said first and second side frames also comprising a rocker seat having an upper surface face, said intermediate portion of each said tension member comprising means for rockably supporting a respective said rocker seat, whereby said first and second side frames are mounted for lateral swinging movement, and means for coupling said first and second side frames together, comprising:

a) semi-rigidly, directly coupling the two rocker seats of the side frames together by tie rods to prevent each said rocker seat rocking independently; and b) supporting the lowermost ends of the suspension springs directly upon the upper surface faces of the rocker seats, whereby increased resistance to lozenging results for lighter railway-car trucks, and a lower deck-height therefor, and whereby such resistance to lozenging is more independent of the weight of the railway-car.

29. The method according to claim 28, wherein said step (a) comprises coupling the two rocker seats directly together by a pair of tie rods arranged substantially parallel to each other.

30. The method according to claim 29, wherein said step (a) further comprises elastomerically coupling each end of each tie rod to a respective rocker seat to provide said semi-rigid coupling.

31. The method according to claim 30, wherein said step of elastomerically coupling comprises sandwiching each portion of the rocker seats operatively connected to an end of a tie rod between a pair of elastomeric pads, and compressing each pair of elastomeric pads against each portion.

32. The method according to claim 31, wherein said step of compressing further comprises automatically limiting the degree to which each pair of elastomeric pads may be compressed.

33. The method according to claim 29, wherein said step (a) further comprises interconnecting intermediate sections of the pair of tie rods in order to provide horizontally stability.

34. The method according to claim 33, wherein said step of interconnecting intermediate sections comprises coupling the ends of a cross-stabilizing element to the intermediate sections, one end coupled to one intermediate section, and the other end coupled to the other intermediate section; said step of interconnecting further comprising elastomerically connecting each end to the respective intermediate section.

35. The method according to claim 28, further comprising:

c) limiting the overall relative lateral movement of a bolster mounted in a bolster-receiving opening with respect to the side frame;

said step (c) comprising abutting a lateral stop surface of the bolster against a lateral stop surface of the rocker seat.

36. A radius or tie rod for semi-rigidly coupling a pair of side frames of a railway-car truck, comprising:

an elongated, intermediate main body portion;

a first end portion;

a second end portion;

each of said first and second end portions comprising a first step-down section of less diametric extent than said intermediate main body portion, and a second step-down section of less diametric extent than said first step-down section;

said second step-down section being located outwardly of said first step-down section and farther away from said intermediate main body portion than said first step-down section;

said first step-down section defining with the end of said intermediate portion a first shoulder surface, and said second step-down section defining with said first step-down section a second shoulder surface, whereby said first and second step-down sections and said first and second shoulder surfaces are used for securing the radius rod to a rocker seat of a frame of a railway-car truck;

each of said first and second end portions comprising a pair of elastomeric elements, each said pair of elastomeric elements being spaced apart and telescopingly mounted about a respective said first step-down section, whereby each said pair of elastomeric elements sandwiches therebetween a projection of a rocker seat of a side frame of a railway-car truck to which the respective said end portion of the radius rod is coupled.

37. The radius or tie rod according to claim 36, in combination with a pair of rockers seats used with a pair of side frames of a railway-car truck; each said rocker seat comprising a main portion and a mounting means for coupling to a respective one of said first and second end portions; each said mounting means being telescopingly received about a portion of a respective said first step-down section and sandwiched between a respective pair of said elastomeric elements; each said mounting means comprising an opening through which passes said portion of the respective said first step-down section.

38. The radius or tie rod according to claim 37, wherein each said mounting means comprises a bracket projecting from said main portion, and a first washer in abutment against said first shoulder surface, and a second washer in abutment against said second shoulder face, and a nut, said second step-down section having a threaded portion for mating engagement with said nut, whereby said nut retains said second washer against said second shoulder to thereby limit the compression of said elastomeric elements.

39. The radius or tie rod according to claim 38, comprising two said radius rods arrange substantially parallel to each other, each said radius rod having a length taken from said first end portion to said second end portion, each said rocker seat having two said mounting means spaced apart from each other in a direction transverse to the lengths of said radius rods, one said mounting means coupled to one of said first and second end portions of one said radius rods, and the other said mounting means coupled to the like end portion of the other of said radius rods.

40. The radius or tie rod according to claim 39, further comprising cross-stabilizing means comprising a first end and a second end coupled between said intermediate portions of said two radius rods, said cross-stabilizing means extending transversely to the lengths of said two radius rods, and means for connecting the first and second ends of said cross-stabilizing means to respective ones of said intermediate portions.

41. The radius or tie rod according to claim 40, wherein said means for connecting the first and second ends comprises welds.

* * * * *